United States Patent [19]

Smith

[11] 4,101,058

[45] Jul. 18, 1978

[54] VARIABLE WIDTH GLASS SPHERE DISPENSER

[76] Inventor: Martin A. Smith, P.O. Box 708, Opa Locka, Fla. 33054

[21] Appl. No.: 787,692

[22] Filed: Apr. 14, 1977

[51] Int. Cl.[2] ..... G01F 11/20

[52] U.S. Cl. ..... 222/274; 222/288

[58] Field of Search ..... 221/225, 266; 222/DIG. 1, 266, 273, 274, 283, 288, 292, 314, 406, 414

[56] References Cited

U.S. PATENT DOCUMENTS

| | | | |
|---|---|---|---|
| 3,163,333 | 12/1964 | Lindaberry | 222/274 X |
| 3,362,581 | 1/1968 | Cordes | 222/274 X |

FOREIGN PATENT DOCUMENTS

| | | | |
|---|---|---|---|
| 75,949 | 3/1953 | Denmark | 222/274 |
| 422,334 | 3/1924 | Fed. Rep. of Germany | 222/274 |

*Primary Examiner*—Robert B. Reeves
*Assistant Examiner*—David A. Scherbel
*Attorney, Agent, or Firm*—Ernest H. Schmidt

[57] ABSTRACT

An apparatus for applying glass spheres or other dry particles at prescribed adjustable widths without wastage of material by gravity feeding such spheres upon a roller assembly comprising a plurality of roller sections selectively engagable for rotation by a continuously driven coaxial drive shaft.

8 Claims, 4 Drawing Figures

VARIABLE WIDTH GLASS SPHERE DISPENSER

BRIEF SUMMARY OF THE INVENTION

The present invention relates to glass sphere dispensing apparatus for applying small glass spheres or other particles of solid material into and onto a coating material. Particular use of the present invention is in the application of glass spheres simultaneous with the applying of a road marking liquid coating such as paint or thermoplastic on pavements and highways in order to provide night-time luminescence to the marking.

Particle dispensing apparatus of the above nature heretofore devised are deficient in various respects, principally in that they are limited to dispensing of particles of a given size efficiently. If such prior devices were doctored to constrict or narrow the width of the discharge orifice, proportionate reduction of particle flow could not be achieved, resulting in too great a consumption of the material. Such prior art devices, moreover, utilized an integral roller for discharge of particles upon the pavement, making it difficult to efficiently block off flow of particles to selective portions of the roller in instances where two or more separated streams or widths of the particles are to be dispensed. It is, accordingly, the principal object of this invention to provide a novel and improved dispensing apparatus of the character described that obviates the deficiencies of such apparatus heretofore devised.

It is another object of the invention to provide means in a dispensing apparatus for varying the individual width or widths of the stream or streams of glass spheres or other particles being dispensed to coincide with the width or widths of the liquid coating pavement marking.

It is a further object of the invention to dispense the particles proportionately without material waste.

Other objects, features and advantages of the invention will be apparent from the following description when read with reference to the accompanying drawings. In the drawings, wherein like reference numerals denote corresponding parts throughout the several views.

DETAILED DESCRIPTION OF THE INVENTION

Figure 1:
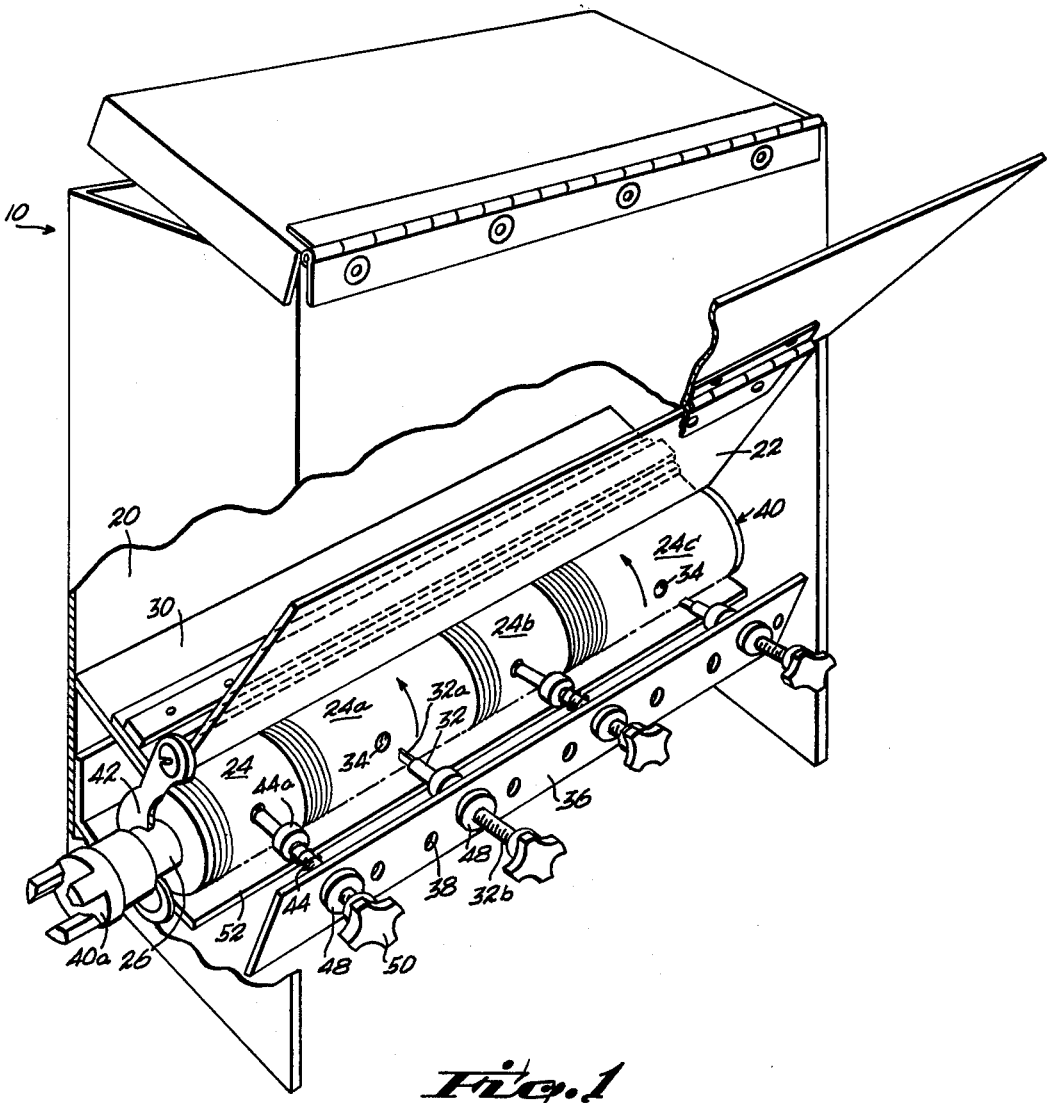
FIG. 1 illustrates, generally, a preferred form of variable width dispenser apparatus embodying the invention.

Referring now in detail to the drawings, reference numeral 10 in FIG. 1 designates, generally, a preferred form of variable width dispenser embodying the invention, the same comprising a holding reservoir or hopper 20 for glass spheres 12 to be dispensed. As best illustrated in FIGS. 1 and 2, the glass spheres 12 slide down an angled plate 22 comprising the hopper or reservoir 20 onto the roller assembly 40 comprising rollers 24, **24*a*, 24*b* and 24*c*, (see FIG. 1**), the peripheral outer surfaces of said rollers being appropriately grooved (partially illustrated along the lengths thereof) to receive and evenly space said glass spheres.

The roller assembly 40 is rotated forwardly, as indicated by the arrows, when driven by the drive shaft 26 upon which they are co-axially journalled. As in hereinafter more particularly described, means is provided for selectively attaching one or more of the rollers 24, **24*a*, 24*b*, 24*c* for discharging a corresponding width or widths of glass streams being discharged to conform with the required width and spacing, (if more than one strip is being applied to the pavement). To this end, locking screws or pins 28 are provided in each of the rollers 24, 24*a*, 24*b*, 24*c* for slectively drivingly interconnecting said rollers with respect to the continuously rotating drive shaft 26. It is further to be noted that only the glass spheres 12 that are deposited within the roller grooves will be dispensed since outer portions of said rollers are constricted by closely adjacent flat surface gate 30**, which will preferably be somewhat resilient and may be constructed of hard rubber or a rubber-like material.

The roller assembly 40 is fitted snugly from end to end within the housing of the dispenser 10, and is journalled therein below the hopper or reservouir 20 by means of bearings 42 at each end. One end of the drive shaft 26 carries a coupling member **40*a*** for interconnection with a rotary drive mechanism (not illustrated) for actuating the glass sphere dispenser when carried along the roadway by an associated transport cart or the like, (not illustrated).

Figure 2:
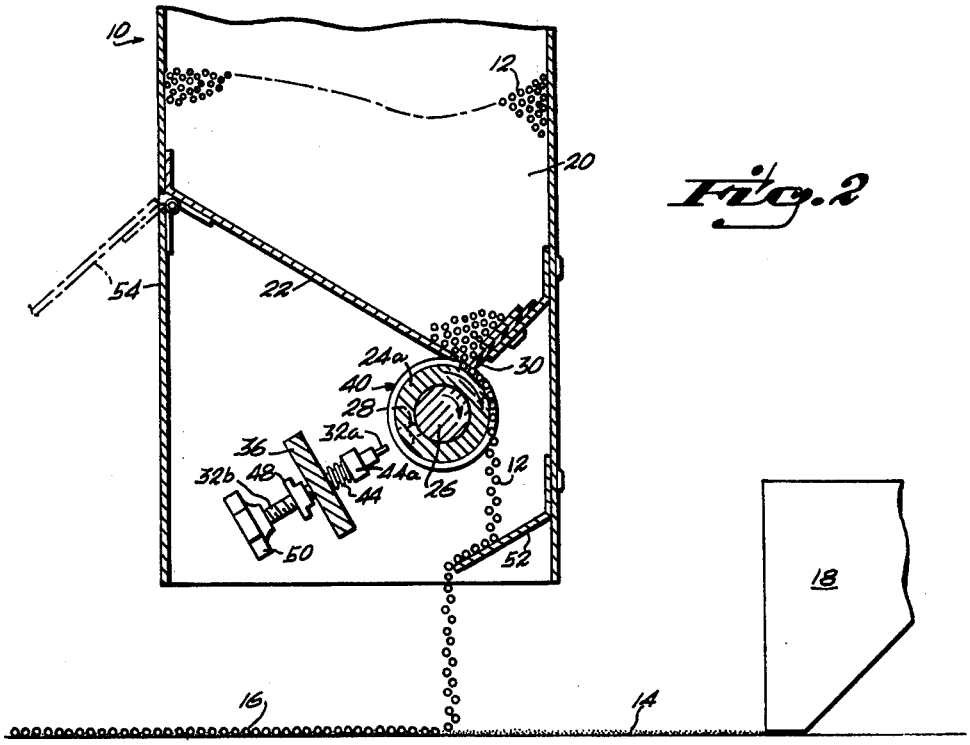
FIG. 2 is a vertical cross-sectional view of the variable width dispenser showing it in operating position.
Figure 3:
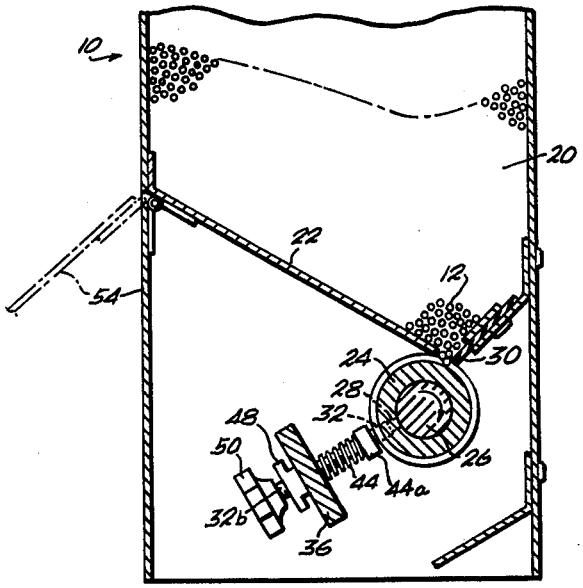
FIG. 3 is a vertical cross-sectional view similar to that of FIG. 2, but showing the device in inoperative position.

As illustrated in FIG. 1, 2 and 3, means is provided for selectively securing the roller sleeves 24, **24*a*, 24*b*, and 24*c* to their common drive shaft 26 for depositing preselected widths of stripes upon the coating to be reflectorized by the glass spheres 12 dispensed. To this end, a transverse support bar 36 is fixed within the dispensing housing 10 in spaced, parallel relation with respect to the outside of the roller assembly, said support bar being provided with a plurality of screw opening 38 a sub-plurality of which are in radial alignment, one each, with radial, threaded openings 34 in the rollers 24, 24*a*, 24*b* and 24*c*. Each of the aligned openings 38 carries, circumjacently received therein, a drive member 32 terminating in a kerf or screw-driver bit 32*a* which is adapted to engage set-screws 28 or the like which may be threadingly received, one each, in openings 34. It will thus be understood that the drive members 32 are each directed perpendicularly with respect to the common axis of the rollers 24, 24*a*, 24*b* and 24*c*, and coaxial with respective openings 28 therein when said roller sections are in such positions that their said openings are opposite their respective drive members, it being understood that said roller sections are independently rotatable about the common drive shaft 26 and are of such length as to provide for various preselected widths of beads to be dispensed. Each drive member 32 has circumjacently received thereon a helical spring 44 constrained between a collar 44*a* and the inside of the support bar 36. The spring 44 is thus operative to urge the tip or screw driver end 32*a* of the drive member 32 into the associated roller opening 34. A knob 50 at the outer end of each drive member 32 enables manual turning of the pertaining set screw or pin 28 in or out for engaging or disengaging the associated roller section, the roller section 24*b* as illustrated in FIG. 1, with respect to the continuously rotating drive shaft 26. With further reference to FIG. 1, roller sections 24*a* and 24*c* are illustrated as being secured to the common drive shaft 26 for dispensing glass spheres, whereas roller sections 24 and 24*b* are illustrated as being in rest or non-operating position, that is, disconnected from drive shaft 26, their associated drive members 26 having been manually controlled to withdraw the respective set screws or pins 28. In this connection it will be noted that when roller sections are placed in inoperative position, their drive members 32 will be left in engagement with their respective attachment screws or pins under the influence of compression springs 44**, thereby constraining said roller sections against inadvertent rotative movement.

FIG. 2 is a cross-sectional view illustrating one of the roller sections in operating position. The roller section **24*a* is illustrated as being engaged with respect to drive shaft 26 by means of the locking or set screw 28. Glass spheres 12 are deposited in the transverse grooves of the roller 24*a* and dispensed in sheet form conforming with the length of the roller 24*b* as the drive shaft 26 is rotated forwardly. The glass spheres 12 slide down the angle plate 22 onto the roller 24*b*, whence they are carried by gravity to be deposited upon angled deflection plate 52 affixed to the housing in spaced, parallel relation below the roller assembly 40. The plate 52 serves to evenly spread any glass spheres 12 that accumulate in and drop from the recessed attachment screw openings 34. When it is desired to lock a roller section 24, 24*a*, 24*b* or 24*c* on the shaft 26, the corresponding securement or set screw 28 will be rotated or otherwise moved by the drive member 32 for its secure attachment to the shaft 26, whereafter said drive member will be pulled clear of the pertaining roller section, and nut 48 threadingly received on threaded portion 32*b* of said drive member will be rotated in the inward direction for abutment against the outside of support plate 36** for retaining said drive member in the retracted position.

An entry or access door 54 hinged with respect to the dispenser housing 10 is provided for access to the entire dispensing mechanism, facilitating observation of operation and servicing.

As illustrated in FIG. 2, in operation the dispenser 10 is located and aligned behind the coating apparatus 18 as the glass spheres 12 pass through the space between the gate 30 and the operating roller for gravity feed upon the predeposited liquid coating 14, thereby to produce the reflectorized coating or strip 16 on the highway.

FIG. 3 illustrates, in vertical cross section, one of the roller sections (section 24) in an inoperative position. As illustrated, the pertaining set screw or pin 28 has been disengaged from the common drive shaft 26 by means of the drive member 32. As hereinabove described, the drive member 32, under the influence of compression spring 44, not only serves to adjust the locking screw or pin 28, but remains engaged with the pertaining roller opening 34 to prevent rotative slippage of the roller section under the influence of friction drive, for example. The screw 28 thus always remains in the corresponding radial opening in its roller section. The set screw or pin 28 is driven in or withdrawn either by rotation, as by use of a screw driver as illustrated, or, alternatively, by a slide or spring machanism providing for in and out movement with respect to the roller section. The compression spring 44 rides freely around drive member 32, being constrained between the support bar 36 at one end and the collar member **44*a* secured to said drive member near its inner end. When the nut 48 is rotated, it frees the drive member so that by holding the knob 40, being affixed to the outer end of said drive member, the operator may push the entire drive member into the opening 34 and thereby remove the screw or pin 28 to disengage from or engage with the common drive shaft 26. When it is desired to lock a roller section 24 on the drive shaft 26, the screw 28 will be rotated or slid securely against the drive shaft 26, the drive member 32 will be pulled clear of the roller section, and the nut 48 rotated to hold the drive member 32** in retracted position.

Figure 4:
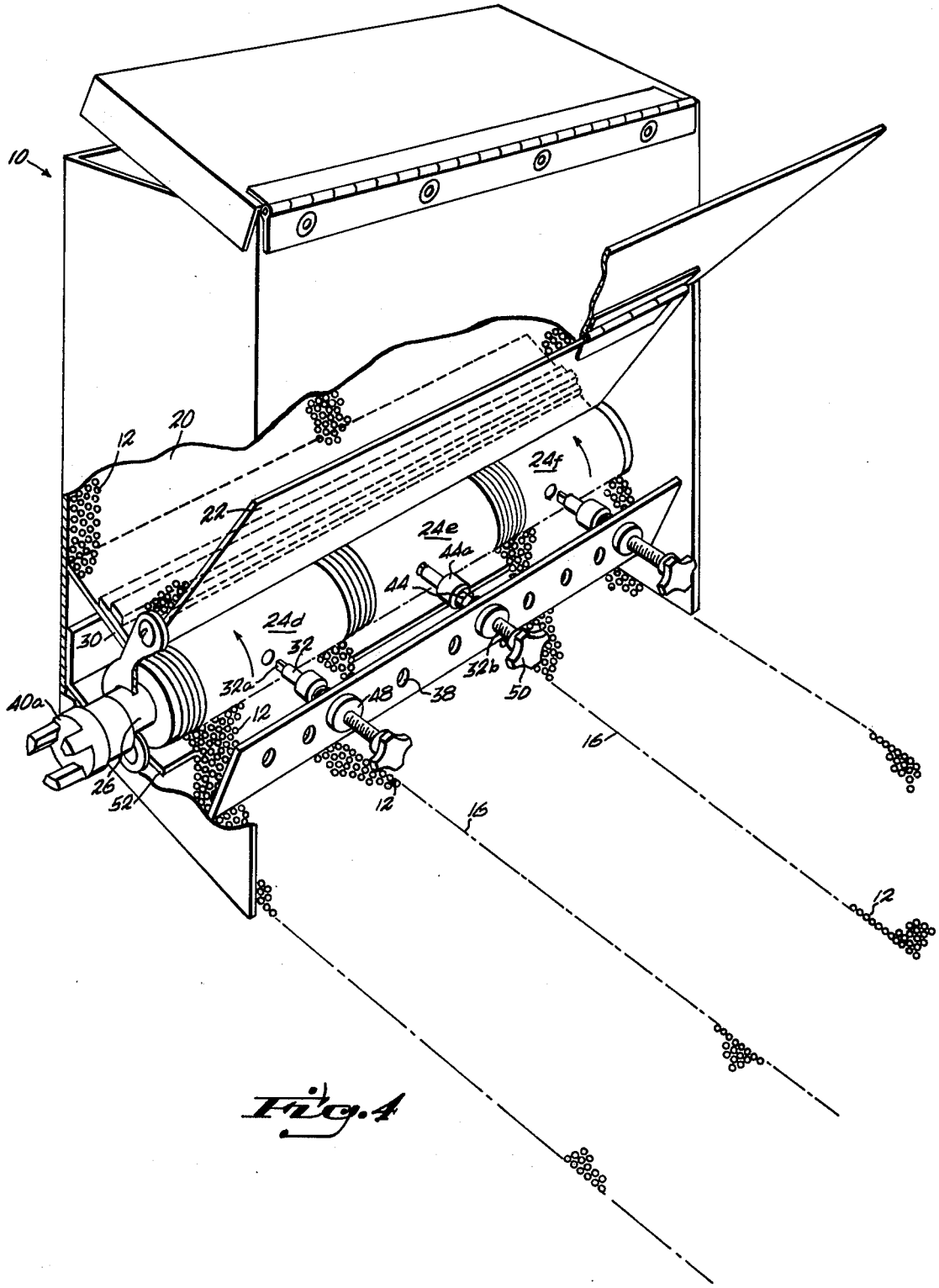
FIG. 4 is a perspective view with portions broken away, similar to that of FIG. 1 but showing a modified form of the invention.

FIG. 4 illustrates, in a view similar to that of FIG. 1 described above, a modified form of the invention wherein roller sections **24*d*, 24*e* and 24*f* are used for other variations of width of strip and spacing between strips to be deposited if two strips are to be deposited. Thus, as illustrated, if the three roller sections 24*d*, 24*e* and 24*f* are each four inches in width, it is possible to deposit two, 4-inch width ribbons or strips of the glass spheres at a spacing of 4 inches by engaging the end roller sections 24*e* and 24*f* and disengaging the central roller section 24*e*. It will be apparent from the foregoing that simply by selecting for operation particular roller sections 24 from a predetermined group of various customarily used widths, it is possible to evenly dispense glass spheres 12** or the like in one or more ribbons or strips of predetermined width and spacing, as may be required.

It will be obvious to those skilled in the art that this device, while having particular application to road marking equipment, may also be used for the dispensing in predetermined widths of particles of any commensurate size. The invention, in brief, comprises all the embodiments and modifications coming within the scope and spirit of the following claims.

What I claim as new and desire to secure by Letters Patent is:

1. In apparatus for dispensing glass spheres or the like at prescribed adjustable widths by gravity feeding such spheres upon a roller, the improvement comprising, a common drive shaft, means for coupling said drive shaft to a rotative source for continuously rotating said drive shaft, a plurality of roller sections coaxially journalled on said drive shaft in substantially abutting end-to-end relation therealong, means for individually and selectively securing said roller sections to said drive shaft for rotation in unison therewith, a hopper above said roller sections for holding glass spheres to be dispensed, and an elongated discharge opening in the bottom of said hopper and substantially coextensive with the combined axial length of said roller sections for depositing glass spheres upon upper surface portions of said roller sections.

2. The invention as defined in claim 1 wherein the outer peripheral surfaces of said roller sections are grooved for the interfitting reception of glass spheres being dispensed, said elongated discharge opening comprising a gate member terminating in closely spaced relation with respect to peripheral surface portions of said roller sections for preventing the through passage of spheres of a given size that are not seated in said grooves.

3. The invention as defined in claim 1 wherein said roller sections securing means comprises a radially-extending opening in each of said roller sections and mechanism axially adjustable in said radial openings for engaging said drive shaft.

4. The invention as defined in claim 3 wherein said axially adjustable mechanism comprises set screws threadingly received, one each, in said radial openings.

5. The invention as defined in claim 3 wherein said roller sections securing means further comprises an elongated support member fixed in spaced, parallel relation with respect to said roller sections, a plurality of through openings in said support member and in alignment, one each, with said radial openings in said roller sections, an elongated drive member extending through each of said support member openings and terminating at one end in means for engaging said drive shaft engaging mechanism in its respective radial opening, means for resiliently urging said drive member in the direction of engagement with said drive shaft engaging mechanism, and manual adjustment grip means at the other end of each of said drive members.

6. The invention as defined in claim 5 and further including means for selectively securing said drive means in the withdrawn position with respect to said drive shaft engaging mechanism.

7. The invention as defined in claim 6 wherein said means for securing said drive means in the withdrawn position comprises a stop nut threadingly engaged on an outwardly extending portion of each of said drive members and abuttingly engageable with respect to an outer surface portion of said support member.

8. The invention as defined in claim 3 and including a deflection plate in spaced parallel relation below said roller sections and substantially coextensive therewith for receiving glass spheres being dispensed by the selective rotation thereof of said roller sections, whereby glass spheres or other particles accumulating within said radial openings will be evenly dispersed during the dispensing.

* * * * *